US005772123A

United States Patent [19]

Augustin et al.

[11] Patent Number: 5,772,123

[45] Date of Patent: Jun. 30, 1998

[54] INJECTOR WITH SOLENOID-VALVE CONTROL FOR FUEL INJECTION INTO DIESEL INTERNAL-COMBUSTION ENGINE COMBUSTION SPACE

[75] Inventors: Ulrich Augustin, Kernen; Volker Schwarz, Weinstadt; Klaus-Juergen Thiele, Nuertingen; Ekkehard Koehler, Goeppingen, all of Germany; Kurt Oberklammer, Neuhofen/Ybbs, Austria; Heinz Rathmayr, Hallein, Austria; Peter Reisenbichler, Traun, Austria

[73] Assignee: Mercedes-Benz AG and Robert Bosch GmbH, Germany

[21] Appl. No.: 547,525

[22] Filed: Oct. 24, 1995

[30] Foreign Application Priority Data

Oct. 24, 1994 [DE] Germany ..... 44 37 927.7

[51] Int. Cl.[6] ..... F02M 59/00

[52] U.S. Cl. ..... 239/533.2; 239/575; 239/584; 239/585.1

[58] Field of Search ..... 239/533.1, 533.2, 239/533.3, 533.6, 533.9, 533.12, 584, 585.1, 575, 462; 210/416.4

[56] References Cited

U.S. PATENT DOCUMENTS

| | | | |
|---|---|---|---|
| 2,067,131 | 1/1937 | Schlaupitz | 239/107.6 |
| 2,445,269 | 7/1948 | Hoffer | 210/164 |
| 4,548,356 | 10/1985 | Hofmann et al. | 239/575 |
| 4,848,658 | 7/1989 | Aketa et al. | 239/88 |
| 4,852,803 | 8/1989 | Gaskell | 239/575 |
| 4,856,713 | 8/1989 | Burnett | 239/533.2 |
| 4,946,103 | 8/1990 | Ganser | 239/88 |
| 5,238,192 | 8/1993 | McNair | 239/575 |

FOREIGN PATENT DOCUMENTS

| | | | |
|---|---|---|---|
| 0 174 083 | 3/1986 | European Pat. Off. . | |
| 0 385 398 | 9/1990 | European Pat. Off. . | |
| 0 385 399 | 9/1990 | European Pat. Off. . | |
| 0 435 183 | 7/1991 | European Pat. Off. . | |
| 0 450 532 | 10/1991 | European Pat. Off. . | |
| 0 616 828 A1 | 9/1994 | European Pat. Off. . | |
| 2208058 | 11/1973 | France . | |
| 1 036 576 | 9/1953 | Germany . | |
| 29 42 853 | 5/1980 | Germany . | |
| 32 19 209 | 9/1983 | Germany . | |
| 35 44 503 A1 | 6/1986 | Germany . | |
| 32 27 742 C2 | 1/1992 | Germany . | |
| 5149208 | 6/1993 | Japan | 239/575 |
| 754528 | 8/1956 | United Kingdom . | |
| 2 198 185 | 11/1987 | United Kingdom . | |

*Primary Examiner*—Andres Kashnikow
*Assistant Examiner*—Lisa Ann Douglas
*Attorney, Agent, or Firm*—Evenson, McKeown, Edwards & Lenahan, P.L.L.C.

[57] ABSTRACT

An injector with solenoid-valve control provided for diesel internal-combustion engines has a lateral fuel delivery conduit into a pressure accumulator reaching, on one hand, as far as the needle seat of a nozzle needle and on the other hand as far as a piston arranged on the rear side of the nozzle needle. A control space in the injector is connected by a controllable solenoid valve to the pressure accumulator or, for pressure relief, to a low-pressure conduit. A fuel filter is arranged in the pressure accumulator in the mouth region of the fuel delivery conduit.

20 Claims, 1 Drawing Sheet

INJECTOR WITH SOLENOID-VALVE CONTROL FOR FUEL INJECTION INTO DIESEL INTERNAL-COMBUSTION ENGINE COMBUSTION SPACE

BACKGROUND AND SUMMARY OF THE INVENTION

The present invention relates to an injector with solenoid-valve control for fuel injection into the combustion space of a diesel internal-combustion engine, and more particularly, to an injector comprising an injector housing, a lateral fuel delivery conduit, arranged in the injector housing and. leading into a pressure accumulator provided between a needle seat of a nozzle needle and a piston arranged on a rear side of the nozzle needle, a control space which is delimited by the piston and is connectable by a controllable solenoid valve to one of the pressure accumulator and, for pressure relief, to a low-pressure conduit.

DE 3,227,742 C2 describes an injector with solenoid-valve control. A lateral fuel delivery conduit opens into an annular inlet space, out of which, on one hand, a conduit leads into a pressure accumulator in the spring space, which surrounds the spring-loaded nozzle needle cooperating with a piston, and out of which, on the other hand, a conduit opens into a control space. The piston limits both the control space and the pressure accumulator. As a result of the actuation of a solenoid valve, the piston previously pressure-loaded in the closing direction can be connected to a relief conduit. That is, when the piston is relieved of pressure on the control-space side, an opening of the spring-loaded nozzle needle is brought about.

In such known injectors, impurities can occur in the flow path and no longer guarantee a perfect functioning of the nozzle and/or of the solenoid valve.

An object of the present invention is, therefore, to provide measures on an injector to allow a fault-free operation of the injector, specifically without a widening of the constructional space of the injector.

This object has been achieved by providing an elongate fuel filter surrounding the nozzle needle at a distance and arranged in the pressure accumulator in a mouth region of the fuel delivery conduit.

Because of the features according to the present invention, the nozzle and solenoid valve are protected from impurities. Constructional changes on the injector having a known lateral fuel delivery conduit, in which it is not possible to accommodate a disc filter or bar filter, are therefore unnecessary on account of the special arrangement of the filter.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
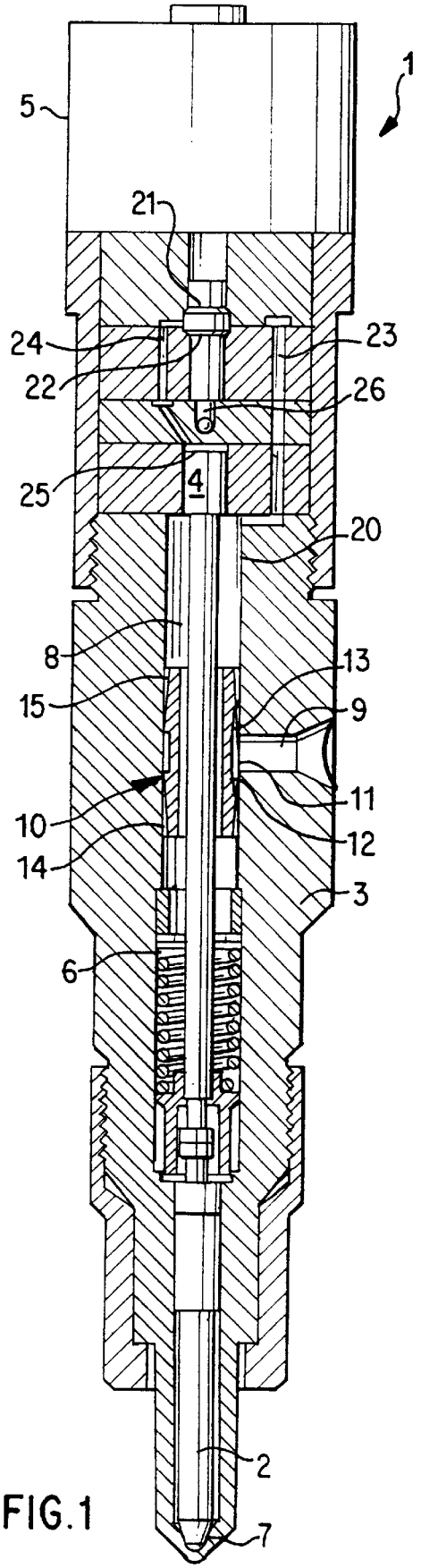
FIG. 1 is a partial cross-sectional elevation view of an injector with solenoid-valve control having a disc filter.

An injector designated generally by the numeral 1 with solenoid-valve control for diesel internal-combustion engines has an elongate nozzle needle 2 in the injector housing 3, a piston 4 on the rear side of the nozzle needle 2 and a solenoid valve 5 arranged in the upper region of the injector 1, as a double-acting directional valve.

The nozzle needle 2 is pressed with slight tension force onto its valve seat 7 by a return spring in the spring space 6. The spring space 6 is also part of a pressure accumulator 8 which reaches as far as the piston 4 and into which opens a fuel delivery conduit 9 extending in the injector housing 3 at right angles to the longitudinal axis of the injector 1.

Figure 2:
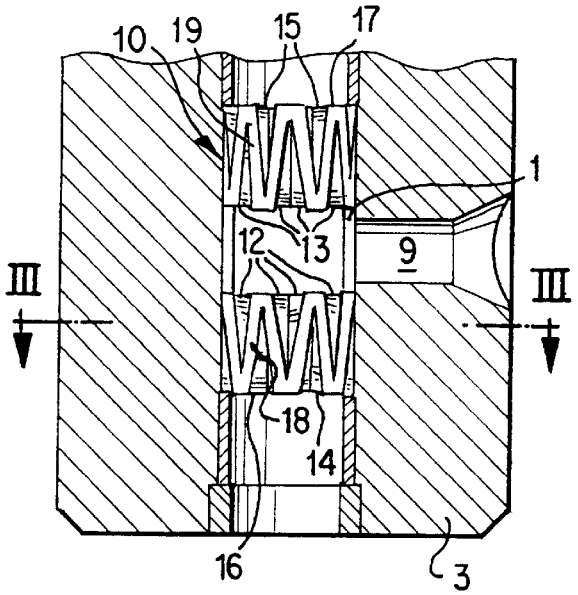
FIG. 2 is a cross-sectional enlarged view of the disc filter.

A cylindrical disc filter 10 is inserted firmly into the pressure accumulator 8 and surrounds the nozzle needle 2 at a distance. The disc filter 10 has on the outside thereof an annular groove 11 which runs level with the fuel delivery conduit 9 and from which blindhole-like filter passages 12, 13 (see especially FIG. 2) distributed uniformly on the circumference lead away on both sides of the annular groove 11. The disc filter 10 can be pressed into the pressure accumulator so that, while its function is preserved, only parts of its circumference perform a function bearing the press fit. Alternatively, the position of the filter 10 can be fixed such that the valve spring is supported fixedly relative to the housing 3 via the disc filter 10.

Figure 3:
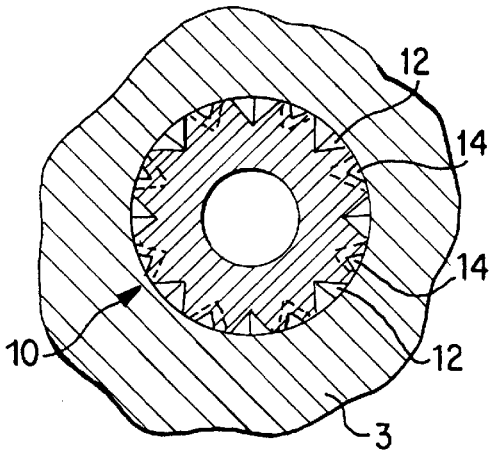
FIG. 3 is a plan cross-sectional view of the disc filter along line III—III in FIG. 2.

Each filter passage is formed by a recess which is worked in on the circumference of the disc filter 10 and which has a triangular cross-sectional shape (FIG. 3) which, starting from the inlet side, tapers increasingly.

The filter passages 12, 13 are adjacent to respective filter passages 14, 15 which are configured identically and which have their largest throughflow cross-section at the piston-side filter end 16, 17. The adjacent filter passages 12, 14 and 13, 15 are separated in each case by an intermediate wall 18, 19 extending from the annular groove 11 as far as the filter end 16, 17 and having a uniform width.

The disc filter 10 is fitted into the pressure accumulator 8 so that impurities first enter the inflow-side filter passage 12 or 13 and, only after a comminution process, are driven via the narrow gap formed by the intermediate wall 18, 19 and inner wall 20 limiting the pressure accumulator 8 into the outflow-side filter passage 14, 15. The comminuted impurities do not exert any harmful influence on the perfect functioning of the nozzle and solenoid valve.

The directional valve, by virtue of its widened double-acting valve part 21, 22, controls either the high-pressure connection from the pressure accumulator 8 containing the fuel filter, via a pressure conduit 23 and control conduit 24, into a control space 25 limited by the piston 4, for loading the piston 4 with pressure, or a low-pressure connection from the control space 25, via the control conduit 24, to a low-pressure conduit 26, for relieving the piston 4 of pressure and consequently for fuel injection through the nozzle needle 2 simultaneously lifting off from the valve seat 7.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An injector with solenoid-valve control for fuel injection into a combustion space of a diesel internal-combustion engine, comprising an injector housing, a lateral fuel delivery conduit arranged in the injector housing and leading into a pressure accumulator provided between a needle seat of a nozzle needle and a piston arranged on a rear side of the nozzle needle, a control space which is delimited by the piston and is connectable by a controllable solenoid valve to one of the pressure accumulator and to a low-pressure conduit for pressure relief, and an elongate fuel filter surrounding the nozzle needle at a distance and arranged in the pressure accumulator in a mouth region of the fuel delivery conduit, said fuel filter being arranged to filter impurities in injected fuel from both the needle seat and the solenoid valve via filter passages therein through which the injected fuel flows from one axial end of the fuel filter to another axial end of the fuel filter.

2. The injector according to claim 1, wherein the fuel filter is a disc filter.

3. The injector according to claim 1, wherein the fuel delivery conduit extends at right angles to a longitudinal axis of the injector.

4. The injector according to claim 1, wherein the fuel filter is arranged at each side of the lateral fuel delivery conduit as viewed along a longitudinal direction of the injector housing.

5. The injector according to claim 1, where the fuel filter has a follow central portion to accommodate the nozzle needle at the distance.

6. An injector with solenoid-valve control for fuel injection into a combustion space of a diesel internal-combustion engine, comprising an injector housing, a lateral fuel delivery conduit arranged in the injector housing and leading into a pressure accumulator provided between a needle seat of a nozzle needle and a piston arranged on a rear side of the nozzle needle, a control space which is delimited by the piston and is connectable by a controllable solenoid valve to one of the pressure accumulator and to a low-pressure conduit for pressure relief, and an elongate fuel filter surrounding the nozzle needle at a distance and arranged in the pressure accumulator in a mouth region of the fuel delivery conduit, wherein filter blind hole-like recesses are provided on the fuel filter, starting from an outer annular groove on the disc filter and from a filter end, and, together with the inner wall of the pressure accumulator, form adjacent inflow-side and outflow-side filter passages separated from one another by an intermediate wall and connected to one another by a gap formed by the intermediate wall and an inner wall of the pressure accumulator to have a filter effect.

7. The injector according to claim 6, wherein the fuel filter is a disc filter.

8. The injector according to claim 6, wherein, starting from the annular groove and starting from the respective filter end, each blindhole-like filter passage has a cross section which tapers increasingly in a longitudinal direction thereof, with an intermediate-wall thickness remaining at least approximately the same.

9. The injector according to claim 6, wherein the annular groove is arranged in a longitudinal center of the elongate disc filter having identically configured filter passages and intermediate walls on both sides of the annular groove.

10. The injector according to claim 9, wherein, starting from the annular groove and starting from the respective filter end, each blindhole-like filter passage has a cross section which tapers increasingly in a longitudinal direction thereof, with an intermediate-wall thickness remaining at least approximately the same.

11. The injector according to claim 9, wherein each of the filter passages has a triangular cross-sectional shape.

12. In a fuel injector of a diesel internal-combustion engine having an injector housing, a lateral fuel delivery conduit arranged in the injector housing, and a nozzle needle in the injector housing, the improvement comprising an elongate fuel filter surrounding and spaced from the nozzle needle and arranged in a mouth region of the fuel delivery conduit, said fuel filter being arranged to filter impurities in injected fuel arranged between a needle seal or the nozzle needle and a solenoid valve operatively associated with the nozzle needle via filter passages therein through which the injected fuel flows from one axial end of the fuel filter to another axial end of the fuel filter.

13. The fuel injector according to claim 12, wherein the fuel filter is a disc filter.

14. The fuel injector according to claim 12, wherein the lateral fuel delivery conduit extends at right angles to a longitudinal axis of the injector housing.

15. In a fuel injector of a diesel internal-combustion engine having an injector housing, a lateral fuel delivery conduit arranged in the injector housing, and a nozzle needle in the injector housing, the improvement comprising an elongate fuel filter surrounding and spaced from the nozzle needle and arranged in a mouth region of the fuel delivery conduit, wherein filter blindhole-like recesses are provided on the fuel filter, starting from an outer annular groove on the disc filter and from a filter end, and, together with the injector housing, form adjacent inflow-side and outflow-side silter passages separated from one another by an intermediate wall and connected to one another by a gap formed by the intermediate wall and inner wall of the injector housing to provide a filter effect.

16. The fuel injector according to claim 15, wherein, starting from the annular groove and starting from the respective filter end, each blindhole-like filter passage has a cross section which tapers increasingly in a longitudinal direction thereof, with an intermediate-wall thickness remaining at least approximately the same.

17. The fuel injector according to claim 15, wherein the annular groove is arranged in a longitudinal center of the elongate disc filter having identically configured filter passages and intermediate walls on both sides of the annular groove.

18. The fuel injector according to claim 17, wherein, starting from the annular groove and starting from the respective filter end, each blindhole-like filter passage has a cross section which tapers increasingly in a longitudinal direction thereof, with an intermediate-wall thickness remaining at least approximately the same.

19. The fuel injector according to claim 17, wherein each of the filter passages has a triangular cross-sectional shape.

20. The fuel injector according to claim 15 wherein the fuel filter is a disc filter.

* * * * *